US005501189A

United States Patent [19]

van Bezeij

[11] Patent Number: 5,501,189

[45] Date of Patent: Mar. 26, 1996

[54] CYLINDER BLOCK FOR AN INTERNAL COMBUSTION ENGINE

[75] Inventor: Nico J. van Bezeij, Stiphout/Helmond, Netherlands

[73] Assignee: Eisenwerk Bruehl GmbH, Bruehl, Germany

[21] Appl. No.: 244,032

[22] PCT Filed: Jun. 24, 1993

[86] PCT No.: PCT/EP93/01613

§ 371 Date: May 16, 1994

§ 102(e) Date: May 16, 1994

[87] PCT Pub. No.: WO94/07017

PCT Pub. Date: Mar. 31, 1994

[30] Foreign Application Priority Data

Sep. 18, 1992 [DE] Germany ..... 42 31 284.1

[51] Int. Cl.[6] ..... F02F 1/36

[52] U.S. Cl. ..... 123/193.1; 123/195 R

[58] Field of Search ..... 123/193.1, 41.74, 123/41.79, 196 R, 195 R

[56] References Cited

U.S. PATENT DOCUMENTS

| | | | |
|---|---|---|---|
| 3,173,407 | 3/1965 | Sampietro et al. | 123/41.74 |
| 4,108,135 | 8/1978 | Kubis | 123/196 R |
| 4,369,739 | 1/1983 | Umemura et al. | 123/41.74 |
| 4,520,768 | 6/1985 | Shimonosono et al. | 123/41.74 |
| 4,771,745 | 9/1988 | Nakamura et al. | 123/196 R |
| 4,773,366 | 9/1988 | Seidl et al. | 123/196 R |
| 5,115,791 | 5/1992 | Dore | 123/196 R |
| 5,148,742 | 9/1992 | Kramer et al. | 123/41.74 |
| 5,188,071 | 2/1993 | Han | 123/195 R |

FOREIGN PATENT DOCUMENTS

| | | | |
|---|---|---|---|
| 0064457 | 11/1982 | European Pat. Off. . | |
| 0473006 | 3/1992 | European Pat. Off. . | |
| 3300924 | 7/1984 | Germany | 123/41.74 |
| 60-13957 | 1/1985 | Japan . | |
| 2073321 | 10/1981 | United Kingdom . | |

*Primary Examiner*—Marguerite Macy
*Attorney, Agent, or Firm*—Spencer & Frank

[57] ABSTRACT

A cast iron cylinder block for an internal combustion engine having a crankcase which defines a region for crankshaft bearings. The cylinder block includes: at least two contiguous cylinders having a dividing plane therebetween; a support web interposed between the cylinders and the crankcase for supporting the cylinders on an upper part of the crankcase, the support web including a bore for fastening screws of a seating for a crankshaft bearing; and a cooling jacket surrounding the at least two contiguous cylinders and including on each side of the two contiguous cylinders, in the dividing plane, at least one reinforcing rib having upper and lower ends and a U-shaped cross-section which defines an inner U-profile extending, at the upper end of the reinforcing rib, into an extension defining a bore for a cylinder head stud screw and extending, at the lower end of the reinforcing rib, into an extension of the bore in the support web.

8 Claims, 9 Drawing Sheets

CYLINDER BLOCK FOR AN INTERNAL COMBUSTION ENGINE

BACKGROUND OF THE INVENTION

The invention relates to a cylinder block for an internal combustion engine, having at least two contiguous cylinders that are surrounded by a water cooling jacket and supported on the upper part of the piston housing.

In piston engines, particularly piston engines for passenger cars, an objective is to reduce the weight as much as possible. Therefore the practice was adopted of manufacturing the cylinder blocks from a light metal, a consequence of which, however, was that two materials must be used, because the bushings had to be manufactured with corresponding cast iron grades.

It is the object of the invention to conceptualize a cylinder block of the type mentioned at the outset as a light block that has high shape-retaining strength and can be manufactured from cast iron.

SUMMARY OF THE INVENTION

This object is attained in accordance with the invention in that, between two cylinders in the dividing plane, the respective outside of the water cooling jacket has a reinforcing rib that is U-shaped in cross-section and continues into the region of the upper part of the crankcase. The effect of this structure is that the forces acting between the cylinder head and the crankshaft support and to be taken up by the cylinder block can be taken up primarily by this reinforcing rib, so all of the remaining wall parts can be configured to be noticeably thinner. The material weight to be used for the U-shaped reinforcing ribs is less than the weight reduction achieved by means of a reduction in the wall thicknesses of the upper part of the crankcase and the housing jacket between the upper part of the crankshaft and the water cooling jacket. It is advantageous here that the inside of the U-profile extends at the upper end in an extension of the bores for the cylinder head studs. In in-line engines, the inside of the U-profile ends at the lower end in an extension of the bores for the fastening screws of the crankshaft support. In V engines, the U-profile ends respectively in the region of the crankshaft support. Because it is primarily the cylinder head studs on the one side and the region of the crankshaft support on the other that must take up the forces active in operation, a defined, linear flux of force results between the cylinder head and the crankshaft support, which flux permits a strength calculation with sufficient precision so that, in dimensioning the remaining, extensively planar parts of the cylinder block that serve as a jacket, the wall thickness practically need only be taken into consideration with respect to problem-free castability.

In an advantageous embodiment of the invention, the reinforcing ribs respectively extend on the top side of the support web from the crankshaft bearing into the foot region of the cylinder block. The resulting increase in shape-retaining strength likewise permits a corresponding reduction in weight.

In a further embodiment of the invention, a jacket rib is provided that adjoins the reinforcing rib of the foot region in the dividing plane, on the inside of the housing jacket. Subsequently, with the given thin-walled configuration of the housing jacket, a reinforcement is achieved, particularly in in-line engines that have at least two cylinders and V engines, by means of which the tendency of this jacket surface to vibrate is reduced, thus preventing roaring. It is also advisable for the jacket rib to have a U-shaped profile in cross-section.

In a further advantageous embodiment of the invention, at least one of the reinforcing ribs having a U-shape in cross-section is configured, at least in the region of the contiguous cylinders, as a closed channel by means of a cover; this channel is provided at the upper end with an inlet opening in the joining plane for the cylinder head, and at the lower end with an outlet opening, forming an oil return channel. This permits at least one oil return channel to be integrated into the cylinder block with the utilization of the already present reinforcing ribs, which channel has a large absorption capacity because of the provided cross-sections, and thus assures rapid return of the lubricating oil from the camshaft region. It is particularly advantageous if the jacket rib provided on the housing jacket for the purpose of reinforcement continues beneath the region of the cylinders as a cored channel on the housing jacket. It is also particularly advantageous to use the jacket rib provided for the purpose of reinforcement, which has a U-shaped cross-section and is used in the cylinder region in the same manner as the reinforcing rib.

BRIEF DESCRIPTION OF THE DRAWINGS

The invention is explained in detail by way of schematic drawings of an embodiment. Shown are in.

DETAILED DESCRIPTION OF THE PREFERRED EMBODIMENTS

Figure 1:
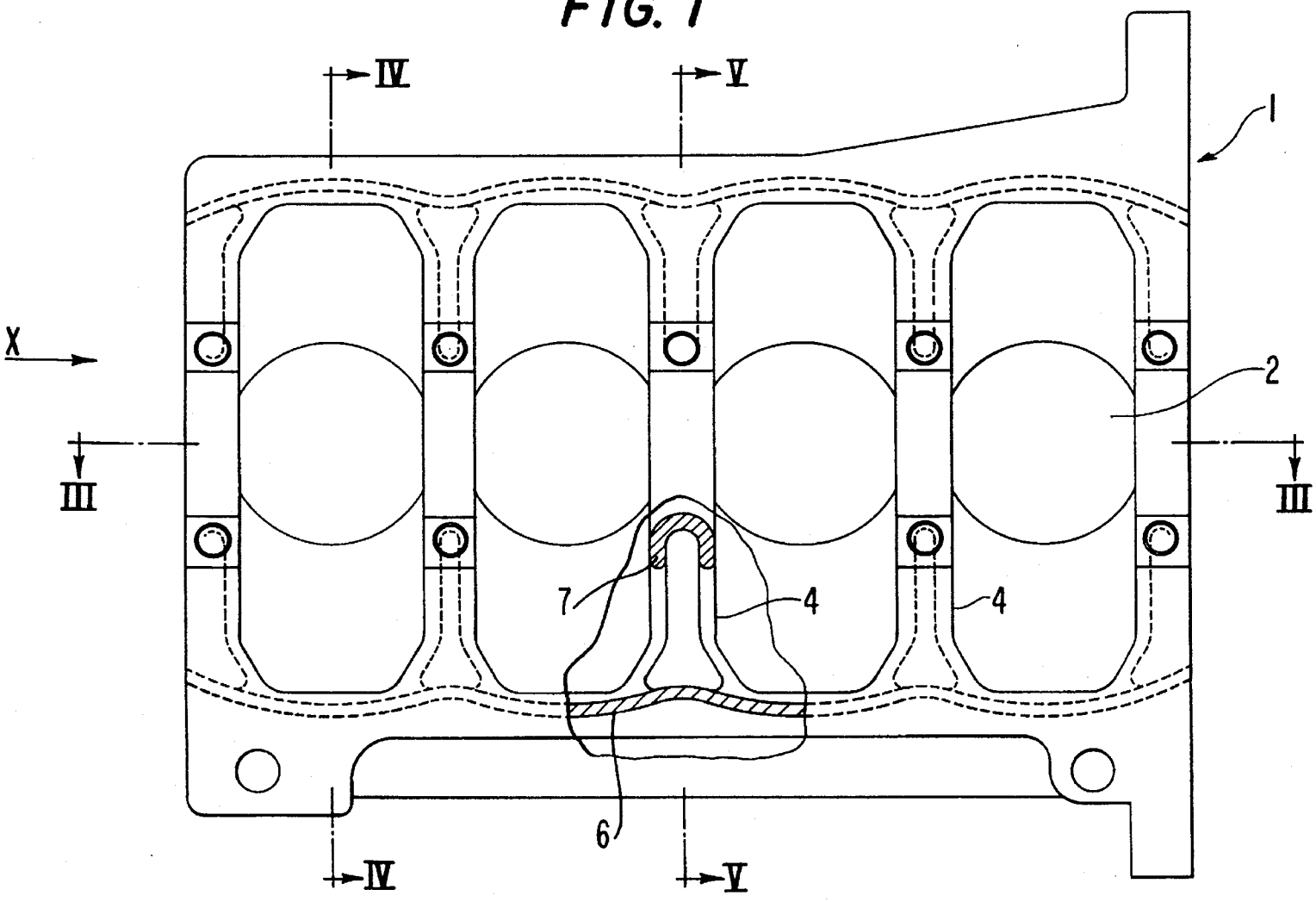
FIG. 1 a top view of a four-cylinder, in-line engine.
Figure 2:
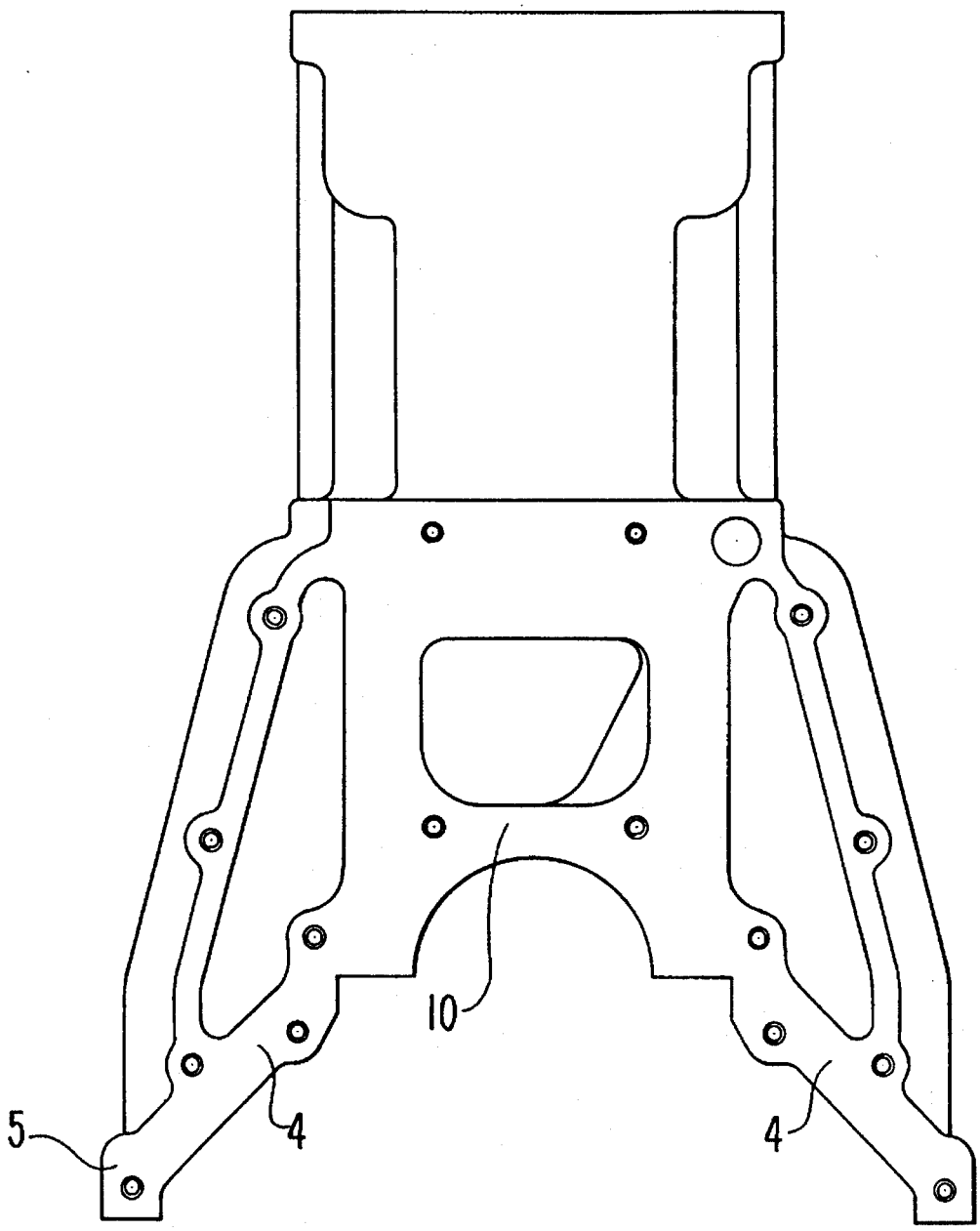
FIG. 2 a front view in the direction of the arrow X in FIG. 1.
Figure 3:
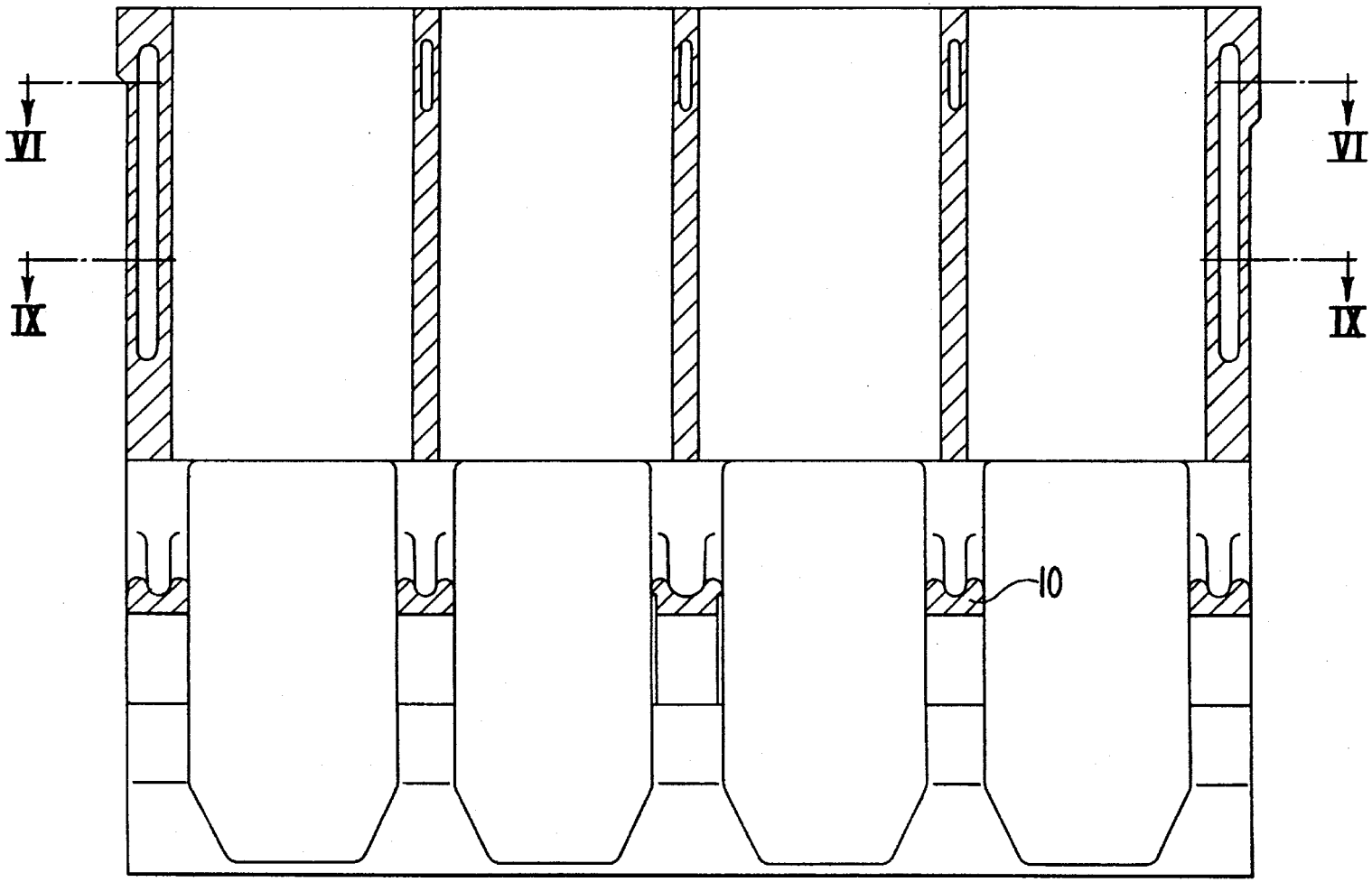
FIG. 3 a longitudinal section along line III—III in FIG. 1.
Figure 4:
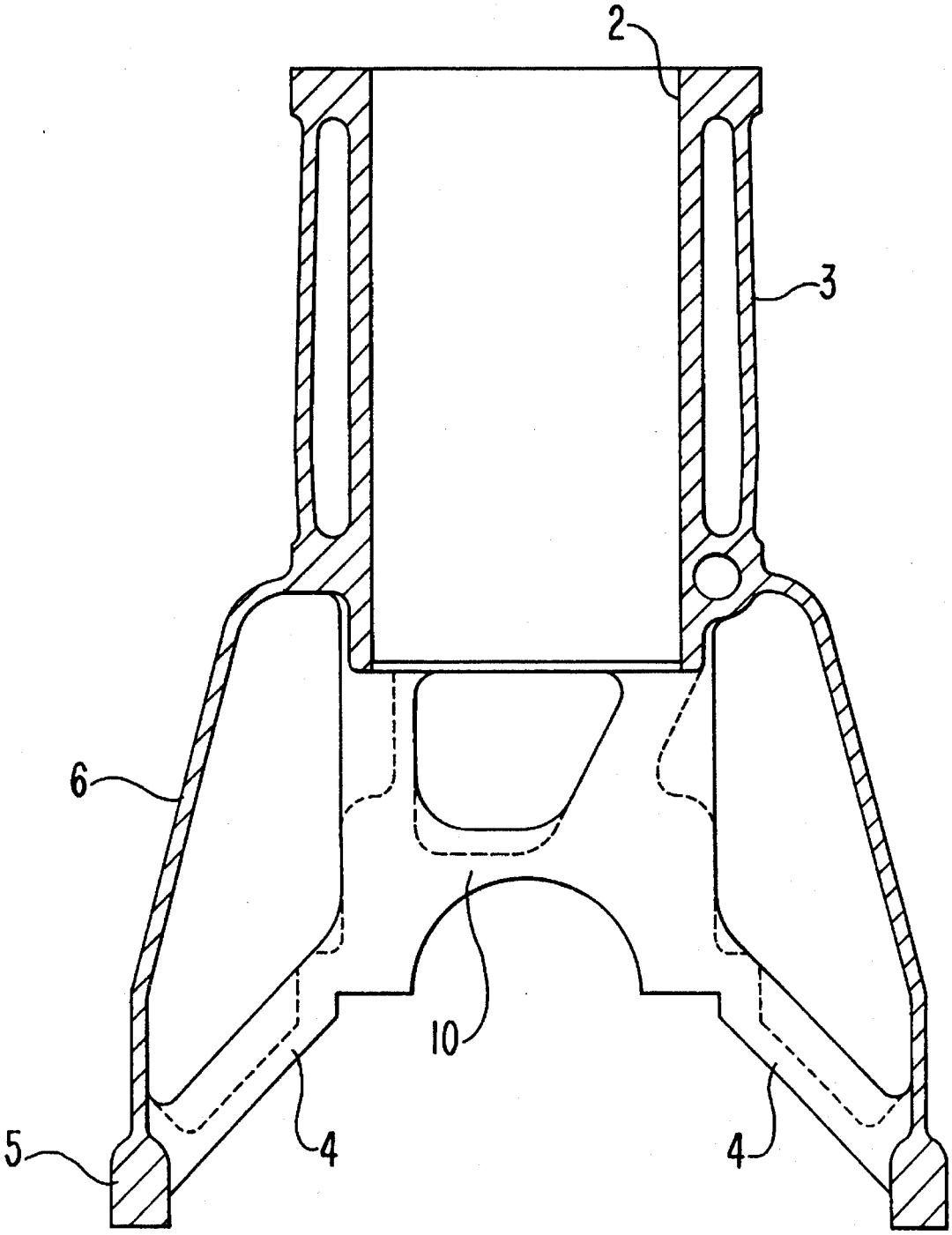
FIG. 4 a cross-section along line IV—IV in FIG. 1.
Figure 5:
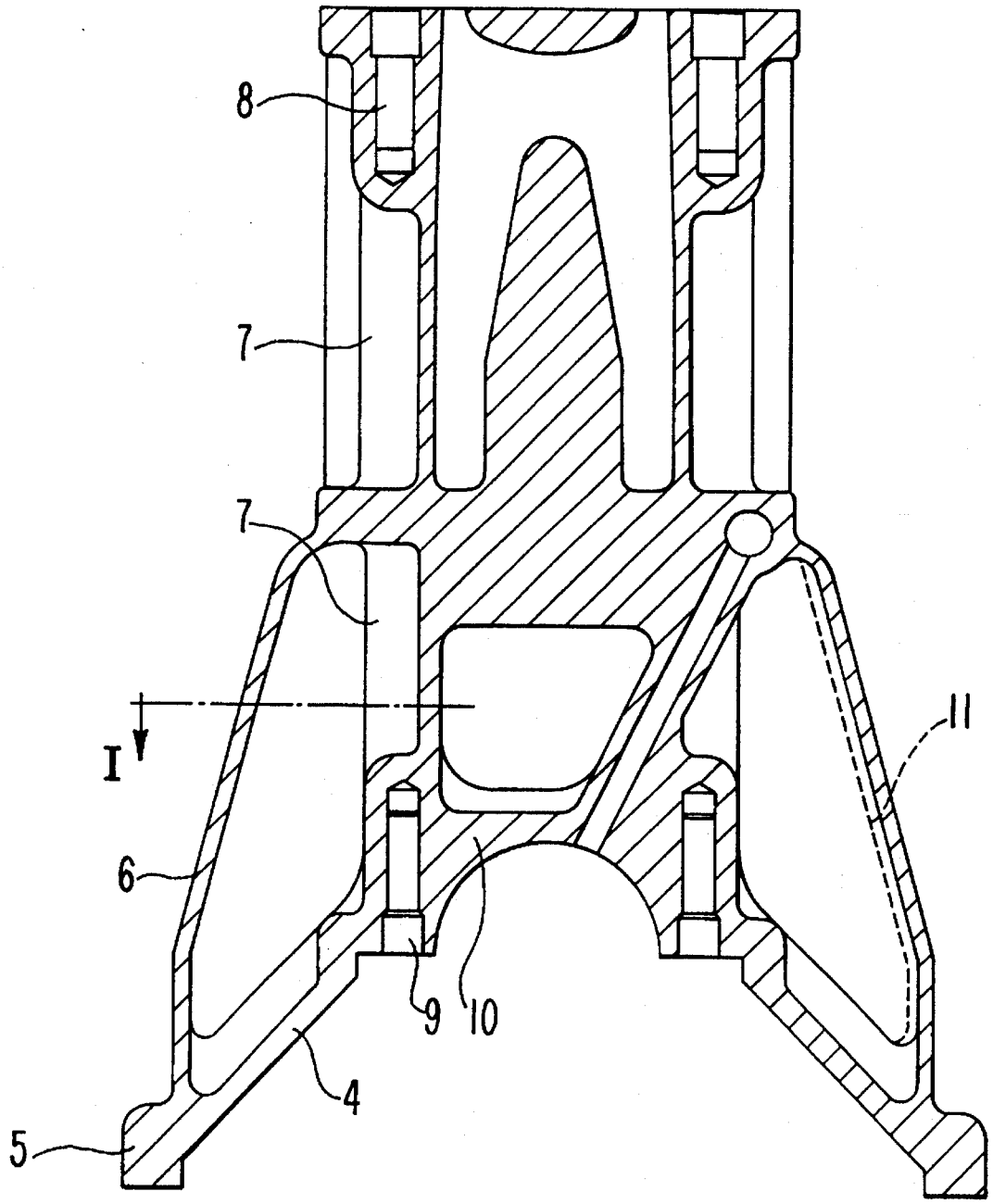
FIG. 5 a cross-section along line V—V in FIG. 1.
Figure 6:
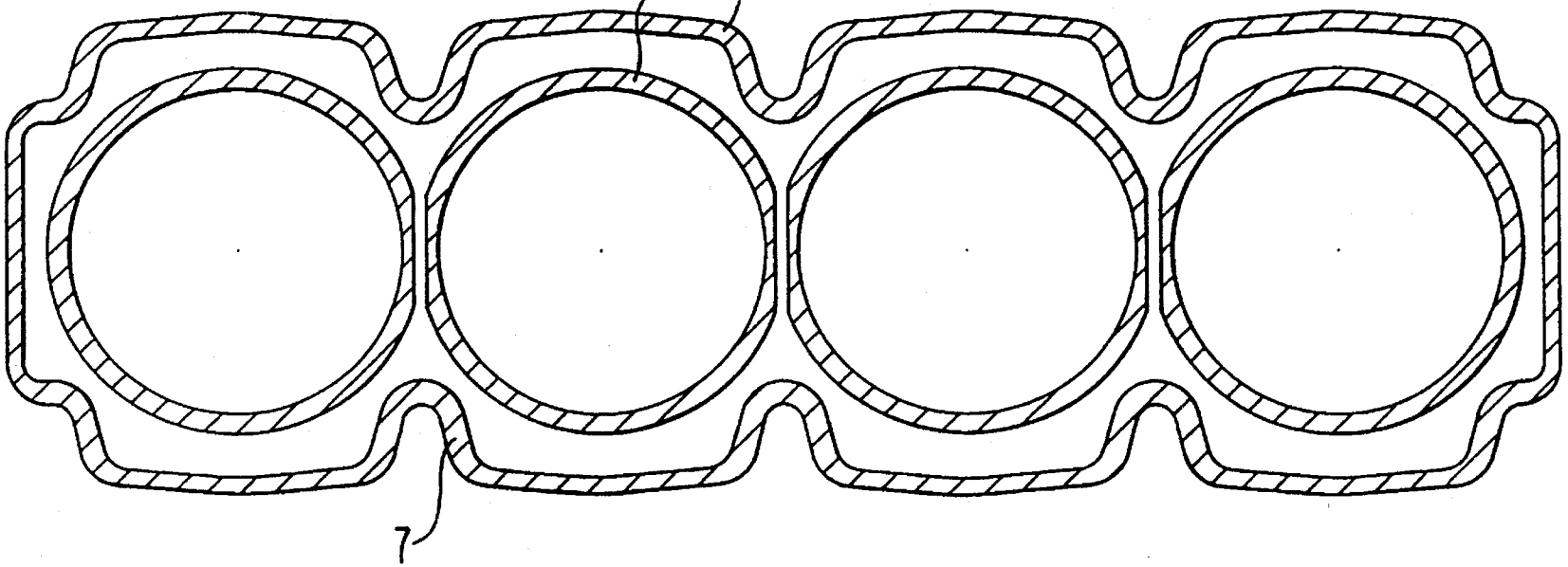
FIG. 6 a horizontal section along line VI—VI in FIG. 3.

The cylinder block 1 illustrated in the top view of FIG. 1 is produced from a cast-iron grade used for cylinder housings, for example compact graphite cast iron (CGG). The cylinders 2 are connected in one piece with the cylinder block 1 and are supported, together with the water cooling jacket 3 (FIG. 4), on support webs 4 for the crankshaft bearings. The support webs 4 extend diagonally outwardly downward into the foot region 5 of the cylinder block 1. To cover the crankshaft space, a housing jacket 6 is provided over the entire length of the cylinder block and extends from the foot region 5 to the lower end of the water cooling jacket (FIG. 4).

To be able to reduce the weight of the cylinder block, only one reinforcing rib 7 that continues downwardly into the region of the support web 4 is provided between two contiguous cylinders 2, in place of a bulkhead, as can be seen in FIG. 1 through FIG. 5. As can be seen in FIG. 1, this reinforcing rib 7 shown in partial horizontal section along line I—I in FIG. 5 has a U-shaped cross-section. The arrangement is configured here such that the inside of the U-profile extends at the upper end in an extension of the bores 8 for the cylinder head stud, and at the lower end in an extension of the bores 9 for the fastening screws of the crankshaft seating. The reinforcing rib forms with its U-shaped cross-section a linear tension element, by means of which the forces becoming active between the cylinder head and the crankshaft bearing are taken up directly. The wall thickness of the housing jacket 6 can correspondingly be reduced.

As can likewise be seen in FIG. 1, for further weight reduction the support web 4 itself is also configured as a U-shaped profile that opens upwardly. In the same way the connecting web 10 between the two outward-lying support webs 4 is configured as an upwardly-open U-profile, which can be seen in FIGS. 4 and 5.

To extensively prevent "roaring" of the very thin-walled housing jacket, the jacket, as can be seen in FIG. 1, bulges outwardly in the region of each cylinder, so that the tendency to vibrate is reduced by the arched shape. To achieve even greater reinforcement, it is advisable likewise to provide the housing jacket 6 with a reinforcing rib 11 in the region of the dividing plane, as indicated in dashed lines in FIG. 5 for the right side of the housing jacket. The rib can be simple, yet have a U-shaped cross-section.

The invention was explained for the example of an in-line engine. It can, however, also be advantageously employed in V engines.

Figure 7:
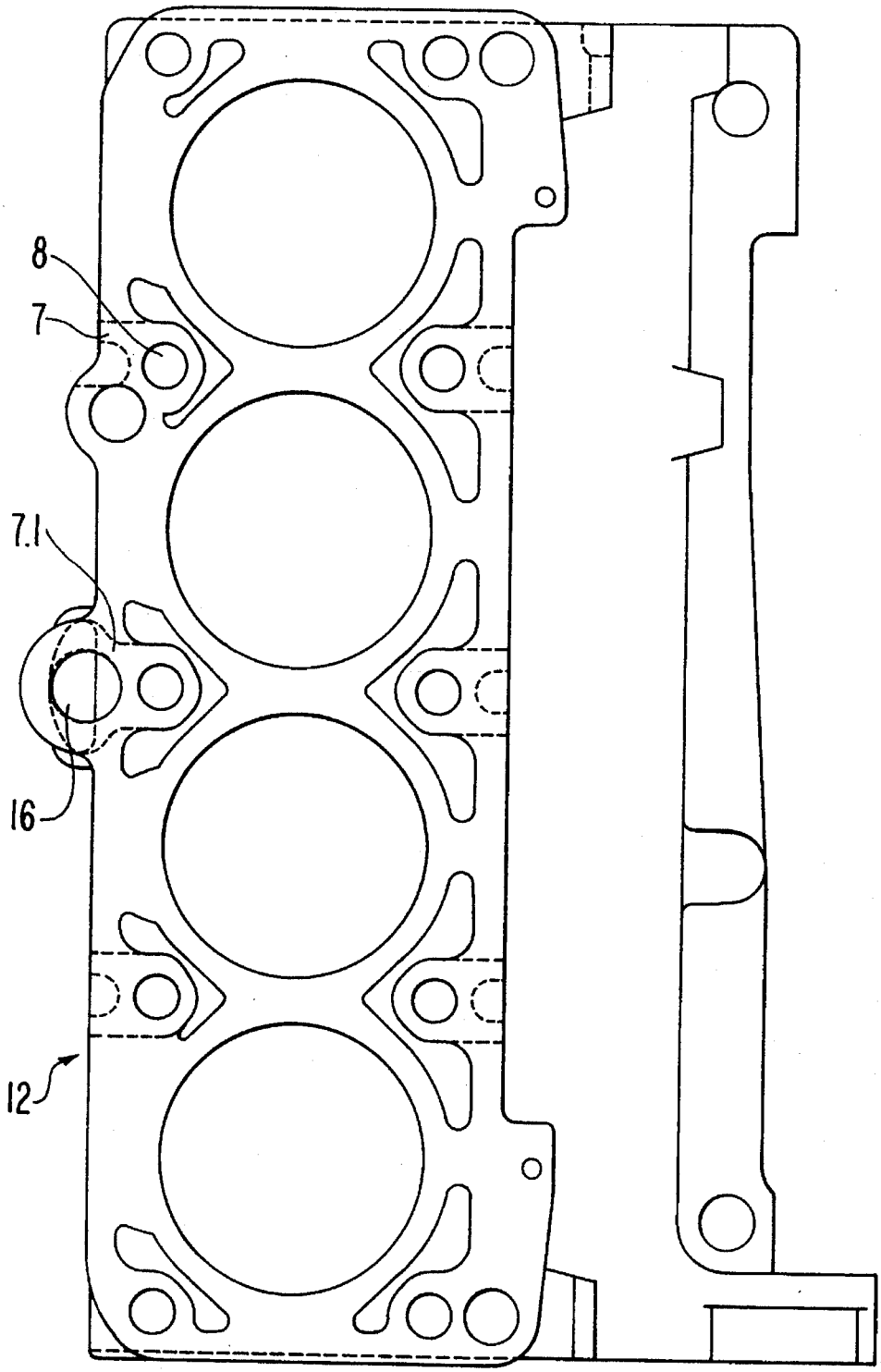
FIG. 7 a top view of a four-cylinder in-line engine having an integrally cast oil return channel, FIG. 8 a vertical section through the cylinder block of FIG. 7 along line VIII—VIII in FIG. 7, FIG. 9 a horizontal section along line IX—IX in FIG. 3.

FIG. 7 is also a top view of a cylinder block 12 for a four-cylinder, in-line engine manufactured from cast iron grade, for example compact graphite cast iron (CGG). The design essentially corresponds to the design of the cylinder block described by way of FIG. 1, so reference can be made to the latter. The same reference numerals are used for identical components. Also in this embodiment, only one reinforcing rib 7 is provided in the region of the dividing plane between two contiguous cylinders 2, in place of a bulkhead, and continues down into the region of the support web. These reinforcing ribs 7 are, as already described by way of the embodiment in FIG. 1 and the associated further drawings, U-shaped in cross-section. Also here, the reinforcing ribs 7 are configured such that they end at the upper end in their extension into the bores 8 for the cylinder head studs.

In a modification of the embodiment in FIG. 1, in the embodiment in FIG. 7, the reinforcing rib 7.1 is provided in the central region of the cylinder block 12 with a cover 13 (FIGS. 8 and 9), so that this reinforcing rib 7.1 is configured as a closed channel. At the upper end, the cover 13 is, as shown in FIG. 8, guided outwardly around the enlargement 14 for the associated bore 8, so that an inlet opening 16 that lies in the joining plane 15 for the cylinder head is formed.

Figure 8:
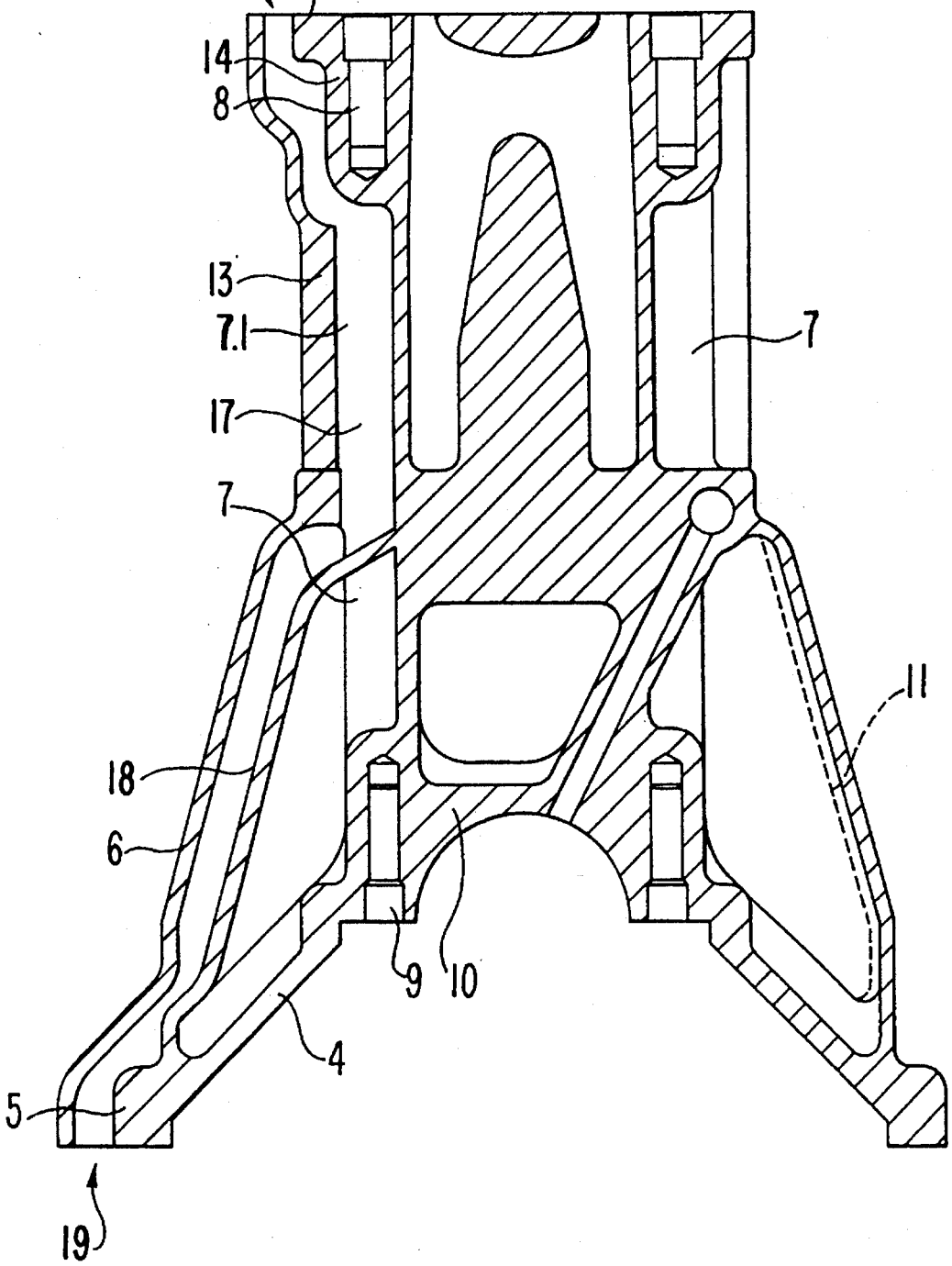

In the illustrated example, this closed channel formed by the cover 13 extends over the vertical longitudinal region of the cylinders, as can be seen in FIG. 8. In the transition region to the housing jacket 6, the channel then continues on the inside of the housing jacket 6, for which purpose the reinforcing rib 11 is used, which rib is provided in this region on the inside of the housing jacket by means of a corresponding cover 18 and has, at least at this location, a U-shaped cross-section. At the lower end, that is, in the foot region 5, a corresponding throughgoing bore is provided that forms an outlet opening 19, similarly to the region of the joining plane 15. In this way a throughgoing channel is available, through which the oil present in the cylinder head region can be carried away.

It is not necessary for reinforcing ribs to be provided in the housing jacket 6 in order to form this oil return channel. It is also possible to provide an integral return channel correspondingly on the housing jacket 6 for the purpose of forming a return channel; this oil return channel must not necessarily extend on the inside of the housing jacket, as shown in FIG. 8, but can also extend on the outside of the housing jacket 6 in connection with the deviation of the throughgoing bore 17 that extends in the longitudinal direction through the entire cylinder block.

Since, as can be seen by way of the embodiment illustrated in FIGS. 1 through 6, the U-shaped reinforcing ribs 7 also extend in the region of the support web 4 to the foot part 5, in the modification of the above-described embodiment according to FIGS. 7 and 8, it is also possible to provide this lower region with a corresponding cover, and thus configure it as an oil return channel.

Figure 9:
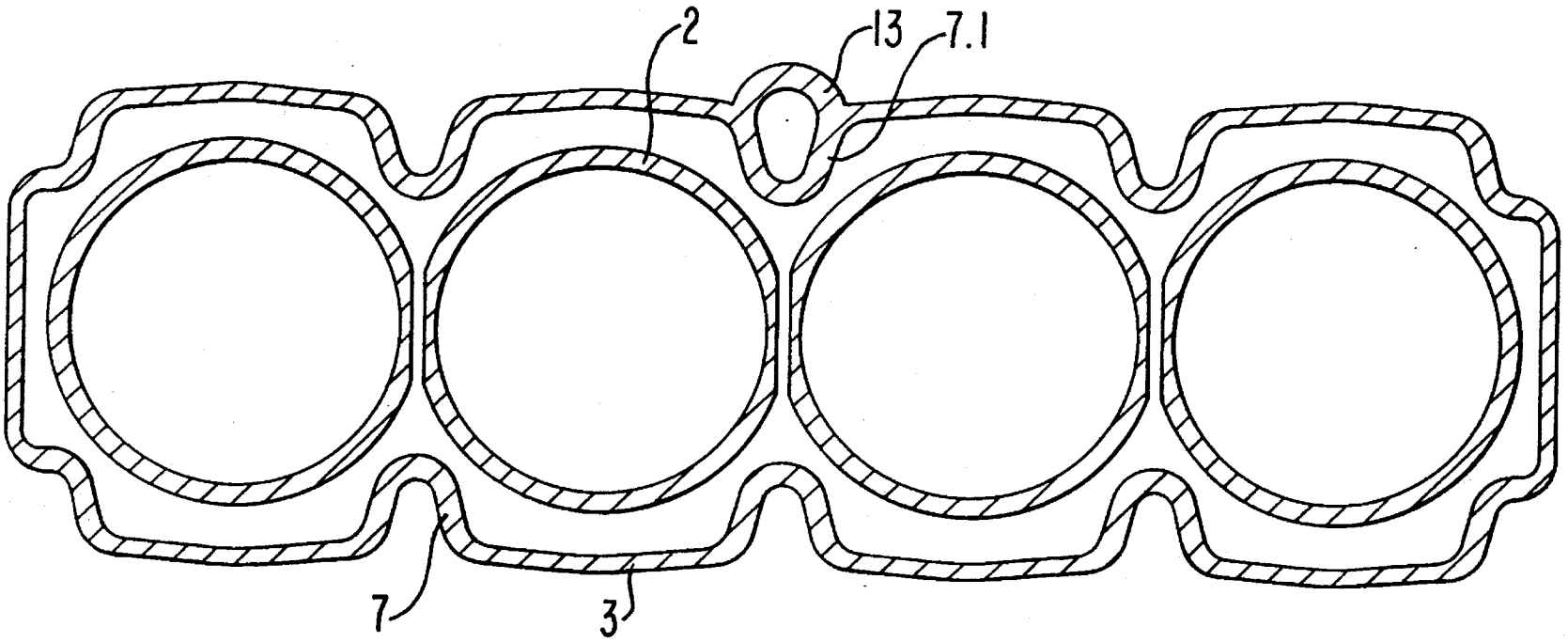

FIG. 9 illustrates, in section, the embodiment of the reinforcing ribs 7 and the embodiment of the central reinforcing ribs 7.1 for forming an oil return channel.

I claim:

1. A cast iron cylinder block for an internal combustion engine having a crankcase which defines a region for crankshaft bearings comprising:

at least two contiguous cylinders having a dividing plane therebetween;

a support web interposed between the cylinders and the crankcase for supporting the cylinders on an upper part of the crankcase, the support web including a bore for fastening screws of a seating for a crankshaft bearing; and a cooling jacket surrounding the at least two contiguous cylinders and including on each side of the two contiguous cylinders, in the dividing plane, at least one reinforcing rib having upper and lower ends and a U-shaped cross-section which defines an inner U-profile extending, at the upper end of the reinforcing rib, into an extension defining a bore for a cylinder head stud screw and extending, at the lower end of the reinforcing rib, into an extension of the bore in the support web.

2. The cylinder block according to claim 1, wherein the support web has a foot region.

3. The cylinder block according to claim 2, wherein the reinforcing rib further extends from the extension of the bore in the support web down to the foot region of the support web.

4. The cylinder block according to claim 2, and further including a housing jacket extending from a lower end of the cooling jacket to the foot region of the support web.

5. The cylinder block according to claim 3, and further including a jacket rib adjoining the reinforcing rib at the foot region of the support web and being disposed inside the housing jacket at the dividing plane.

6. The cylinder block according to claim 5, wherein the jacket rib has a U-shaped cross section.

7. The cylinder block according to claim 1, wherein the at least one reinforcing rib includes a plurality of reinforcing ribs, at least one of the reinforcing ribs including a cover thereby defining a closed return channel, the return channel having an inlet opening at the joining plane of the cylinders and an outlet opening.

8. The cylinder block according to claim 7, wherein the return channel is an oil return channel extending below the cylinders as a cored channel on the housing jacket.

* * * * *